US006209359B1

(12) United States Patent
Desgrand

(10) Patent No.: US 6,209,359 B1
(45) Date of Patent: Apr. 3, 2001

(54) MANUFACTURING PROCESS OF LOOPS ON A SHEET THROUGH KNITTING, LOOP MATERIAL MANUFACTURED BY THIS PROCESS AND ITS USE

(75) Inventor: Bernard Desgrand, Peaugres (FR)

(73) Assignee: APLIX, a limited company, Paris (FR)

( * ) Notice: Subject to any disclaimer, the term of this patent is extended or adjusted under 35 U.S.C. 154(b) by 0 days.

(21) Appl. No.: 09/348,694

(22) Filed: Jul. 7, 1999

(30) Foreign Application Priority Data

Jul. 8, 1998 (FR) ..... 98 08739

(51) Int. Cl.[7] ..... D04B 23/08

(52) U.S. Cl. ..... 66/84 R; 66/203; 66/191; 66/195; 66/194

(58) Field of Search ..... 66/191, 192, 193, 66/190, 195, 83, 84 R, 85 R, 85 A, 194, 200, 202, 170, 177; 24/442, 445

(56) References Cited

U.S. PATENT DOCUMENTS 2,890,579 * 6/1959 Mauersberger ..... 66/192
3,452,561 * 7/1969 Stourland et al. ..... 66/192
3,540,238 * 11/1970 Sharpe ..... 66/192
3,611,754 * 10/1971 Ehrlich et al. ..... 66/192
4,003,222 * 1/1977 Wunner ..... 66/191
4,931,343 * 6/1990 Becker et al. ..... 66/191

* cited by examiner

*Primary Examiner*—Danny Worrell
(74) *Attorney, Agent, or Firm*—Adams, Schwartz & Evans, P.A.

(57) ABSTRACT

A loop manufacturing process which utilizes a gang of needles, each including a closing string and a hook, and at least one transverse gang of small strainers located on either side of a sheet in conventional fashion, together with a transverse gang of longitudinal lancets. The sheet is continually fed from the top to the bottom of a knitting machine to obtain a loop material forming one of two cooperating parts of an self-gripping strap. After the formation of at least a first loop on a lancet and before the formation of a second loop on the lancet, the lancet holding the first loop moves transversely in one direction and by a predetermined distance. After the formation of the second loop on this lancet, the lancet holding the first and second loop moves transversely by the same distance but in the opposite direction, before and for the formation of a third loop on this lancet. The cycle of transverse movement of the lancet in one direction and then the other is repeated every two loops.

22 Claims, 4 Drawing Sheets

Figure 1A:
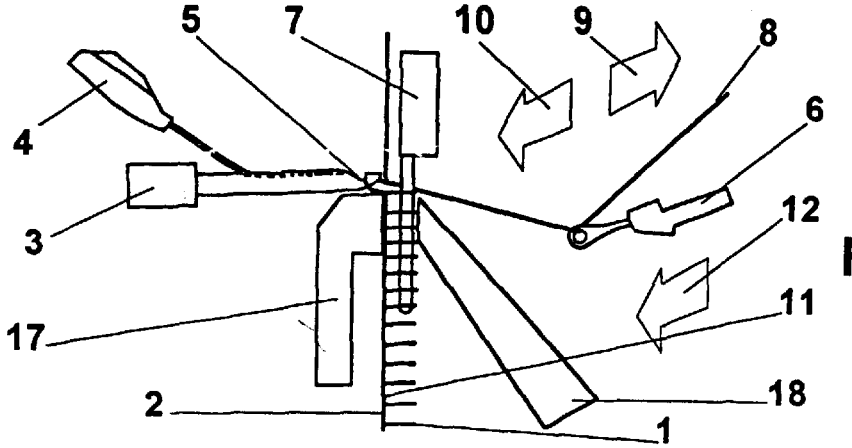

MANUFACTURING PROCESS OF LOOPS ON A SHEET THROUGH KNITTING, LOOP MATERIAL MANUFACTURED BY THIS PROCESS AND ITS USE

TECHNOLOGICAL BACKGROUND OF THE INVENTION

Auto-gripping straps are an extremely widespread application in the manufacturing of clothing, or generally, in domestic applications.

Said straps consist of two parts. A first part comprising of the loops which are destined to cooperate, through a redundant hooking link, with a second part, for instance hooks, string-like elements with an over-sized head, analogue elements, etc.

For evident, cost-based reasons, particularly important when single-use articles are to be mass-produced, notably diapers, one has to research economical manufacturing processes.

An economical process known for garments, for instance in the form of bands, of the part comprising the loops of this type of strap, is the manufacturing of a laminate consisting of a chained or weft material with loops counter-glued on a support.

However, this process is relatively complex, in so far as it necessitates a separate preparation for each of the two external layers of the laminate, then a technically complex gluing operation.

The present invention therefore relates to the manufacturing process of a loop cloth, the steps of which are fewer and therefore simpler than those intervening in the manufacturing of a laminate.

A process of this type is put to use on a knitting machine, modified to produce a loop cloth, described in the American U.S. Pat. No. 4,003,222, published on Jan. 18, 1977.

The modification consists of the transformation of the fixed lancets system in a mobile system. The lateral movement of the lancets allows for high-speed hook manufacturing, with a very high degree of dimensional stability, over a knit framework.

The manufacturer of this machine, the German company LIBA MASCHINENFABRIK, had solved the problem of optimal control of the string in an original and efficient fashion.

It is also with a view to increase the speed and quality of production guides can be used on this machine type, as for instance on the knitting machine of the aforementioned company, described in the European patent application EP 511580, published on Nov. 4, 1992.

However, regardless of the quality of the product manufactured, the problems that arise from the mechanically fragile and dimensionally unstable structure of a knitted material remain.

Another known process consists of inserting loops in a sheet. The material this sheet is made of could feature all required characteristics, both in terms of resistance and flexibility.

Textile machinery that can operate this process is available on the market in different forms.

The main machine is manufactured by the company MALIMO. It produces stitched loops from a simple or double knit armor. The machine includes a gang of fixed lancets.

There also exist a few machines using hooks, which produce loops either as frames or stitched, by insertion on a sheet. In this case, the lancets are still fixed.

The fact that loops manufactured through these processes are flat on the surface of their support is a negative consequence of the fixedness of lancets. The ease of strapping complementary elements of the strap is therefore naturally decreased compared to the expected result of using perfectly straight loops.

The conclusion derived from the above review of the existing state of the process is that manufacturing processes that knit loops on a sheet are known, but there exist no simple and economical process that provides full satisfaction today. Particularly, loop cloth manufactured by those processes features neither the dimensional stability nor the structural characteristics required for heavy-duty applications, notably diapers.

GENERAL DESCRIPTION OF THE INVENTION

The present invention relates to a manufacturing process of knitting loops on a support, for instance a sheet, which will remedy inconveniences featured by prior manufacturing processes.

Its precise purpose is a loop manufacturing process making use of, as means themselves known, a transversal gang of needles, each comprising a closing string and a hook, and at least one transversal gang of small guides. These gangs are located on either side of said sheet, in a conventional fashion. A transversal gang of longitudinal lancets is also used.

In this process, the sheet is continually fed from the top to the bottom of a knitting machine, the above gangs of which are its main components, notably to obtain a loop material constituting one of the two cooperating parts of an auto-gripping strap.

In a known fashion, the longitudinal loop columns are produced on one side of the sheet with driving the knitting strings from the small strainers onto the corresponding lancets, on the one side. On the other side, the loops are restrained on the sheet with driving the knitting strings back on the other side of the sheet.

Following a known manufacturing process of loop-knitting onto a sheet, after the production of at least a first loop on a lancet, and before and also for the formation of a second loop on this lancet, the lancet holding the first loop moves transversally in one direction and by a predetermined distance. After the formation of the second loop on this lancet, again the lancet holding the first and second loop moves transversally by the same distance but in the opposite direction, before and for the formation of a third loop on this lancet. The cycle of transversal movement of the lancet in one direction and then the other is repeated every two loops.

According to this process, the lancets are located against the side of the sheet that guides. A variation can be broken down into four cyclically repeated steps:

A first step during which, successively, the needles having moved from the lower position to the back position, the seam having been completed by a mechanical process known as felling, the sheet advances by one stitch, the lancets move transversally and the small guides accomplish a first lateral movement in the opposite direction behind the needles, A second step during which, successively, the needles move towards the small strainers, punch through the sheet, move through the comb of lancets, then the small guides accomplish a first longitudinal movement towards the top, followed by a second lateral movement of a step towards the initial direction, A third step during which, successively, the needles begin their return to the back position, then the small guides move under the needles by a second longitudinal movement towards the bottom, the second longitudinal movement having for effect to snare each of the strings in the hook. The closing strings then begin to close the needles, A fourth step during which, successively, the closing strings having closed the needles, those carry on their return to the back position until the moment when, the strings moving through the sheet and forming the loops on this first side, the felling is completed. The needles carry on towards the lower position and finally the closing strings open said needles.

According to this process, one obtains loops on one side of the material, alternately and transversally oriented to the left and to the right. On the other side of the material (to the bottom, on the side of the needles), one obtains stitches, which maintain the loops in a more-or-less vertical position. However, from the totality of the string used, a major part (up to 50%) is used to form the stitches and the remainder is used for the loops.

Following the invention, the role of the stitches and loops is inverted. Once the cloth is obtained from intermediary loops on the upper side and "knitted" stitches on the under side, the process according to the invention includes a further step during which stitches are pulled downwards, so that the string on the upper side that forms the intermediary loop is pressed against the material and the stitching strings are taken away from the material to form a double loop.

Many more loops are therefore obtained for an identical quantity of string and less string is used for the simple task of support. This is obtained by a process according to the invention, the steps of which include:

to realize longitudinal columns of intermediary loops on one side of the support material, and columns of stitches on the other side, with driving the string brought by small strainers located on one side of the support material with needles, on lancets located on the same side of said support material, to retain the intermediary loops on the support, with driving the string on the other side of the support, after the formation of at least the first of the intermediary loops on one of the lancets, to move the lancet which holds the first intermediary loop transversally by a predetermined distance and in one direction, so that a second intermediary loop may be created and, after the formation of the second intermediary loop on the lancet, to move again the lancet holding the first and second intermediary loop transversally and by the same distance in the opposite direction, so that so that a third intermediary loop may be created on this lancet. The cycle of transversal movement of the lancet in one direction and then the other repeats every two intermediary loops, characterized in that it also includes the step consisting of pulling on the intermediary loops whilst moving them away from the support, to therefore create the loops. The intermediary loops are then flat against the support to form the retaining sections.

According to a refinement of the invention, a layer of glue is applied to the support on the side of the retaining sections to glue the retaining sections to the support.

According to another mode of realizing the invention, a process following the invention consists of:

realizing longitudinal columns of loops on one side of the support by driving the string brought by small guides located on the other side of said support, with needles, onto lancets located on the said one side of the support, retaining the loops on the support by driving the string on the other side of the support, after the formation of a first loop on one of the lancets, moving the lancet holding the first loop transversally in one direction and by a predetermined distance, so that so that a second intermediary loop may be created and, after the formation of a second loop on the lancet, again move the lancet holding the first and second loop transversally in the opposite direction and by the same distance, so that so that a third loop may be created on this lancet, the cycle of transversal movement of the lancet in one direction then the other repeating every two loops.

In this variation of the invention, the formation of the loops on the under side of the material is directly realized by the positioning of the lancets on the side of the needles, and the pulling of the final loops towards the bottom is made directly by the needles.

According to a refinement of the invention, the process includes:

a first step during which, successively, said needles having moved from the lower position to the back position, the felling having just completed, the support advances by one stitch, the lancets move transversally and the small guides accomplish a first lateral movement in the said opposite direction behind said needles, a second step during which, successively, said needles move towards the small guides punch through the support, move through the comb of the lancets, then the small guides accomplish a first longitudinal movement towards said top, followed by a second lateral movement of a step towards the said initial direction, a third step during which, successively, said needles begin their return to the back position, then said small strainers move under said needles by a second longitudinal movement towards said bottom, said second longitudinal movement having for effect to snare each of said strings in said hook, then said closing strings begin to close said needles, a fourth step during which, successively, said closing strings having closed said needles, said needles carry on their return to the back position until the moment when, said strings moving through the sheet and forming said loops on said first side, the felling is completed. Said needles carry on towards the lower position and finally said closing strings open said needles.

Said first, second, third and fourth steps taking place in a cyclical fashion.

A particularly good support of the loops on the material is achieved.

According to a refinement of the invention, impacts of the needles on the support are made to zigzag.

A better support of the loops on the material is therefore achieved.

The present invention also applies to a loop cloth comprising of a textile support and at least one string, the string defining loop sections on one side of the support and corresponding retaining sections on the other side of the support, characterized in that the length of each retaining section is inferior to that of the corresponding loop section.

According to the invention, the majority of the string is used to form loops. This is particularly advantageous in the case of the female part of a Velcro strap element where one wishes for the string to be especially used for forming the loops, which are the active elements of this female part.

According to a refinement of the invention, each retaining section is fully in contact with the support. The length of string used to form the retaining sections is therefore minimal.

According to another refinement of the invention, each loop section constitutes of a double loop.

Therefore, the loop material according to this invention very advantageously features columns of loops, formed by the stitches of the material used for the anterior garment, including a double loop per step, the feet of which are sensibly perpendicular to the sheet.

Strings that constitutes loops are preferentially polyamide or polyester strings, whereas the sheet, or support, is preferentially constituted by a polyester, polyethylene or polypropylene film or non-woven variation, with a density comprised between fifteen and twenty g/m$^2$.

A characteristic use of the loop material manufactured by the process according to the invention is the manufacture of articles including auto-grip strapping parts, advantageously seamlessly integrated to those articles rather than appended, as with diapers for instance.

The invention will be well understood with reading the following description and with reference to the Figures featured as appendixes, which from part of the description and in which:

FIGS. 1*a,* 1*b,* 1*c* and 1*d* illustrate a knitting machine, apt to action the process, showing the four essential steps of the first variation of the manufacturing process by knitting the loops on a sheet according to the invention.

Figure 2A:
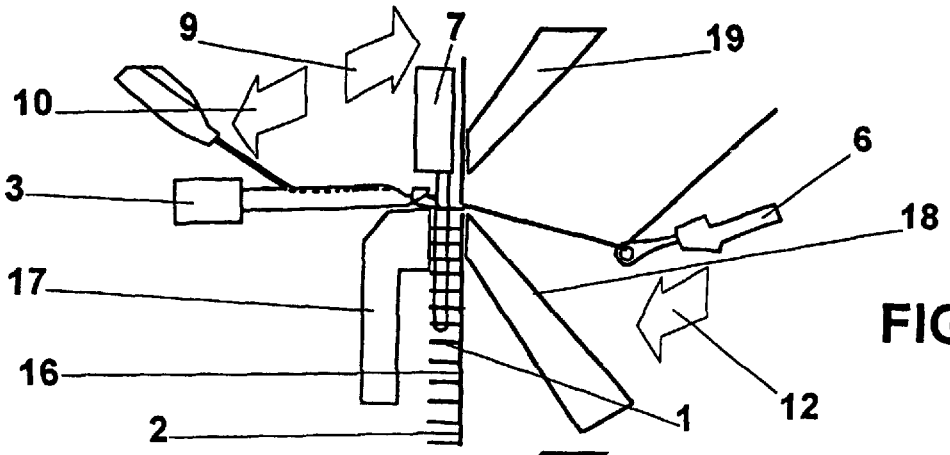
Figure 2B:
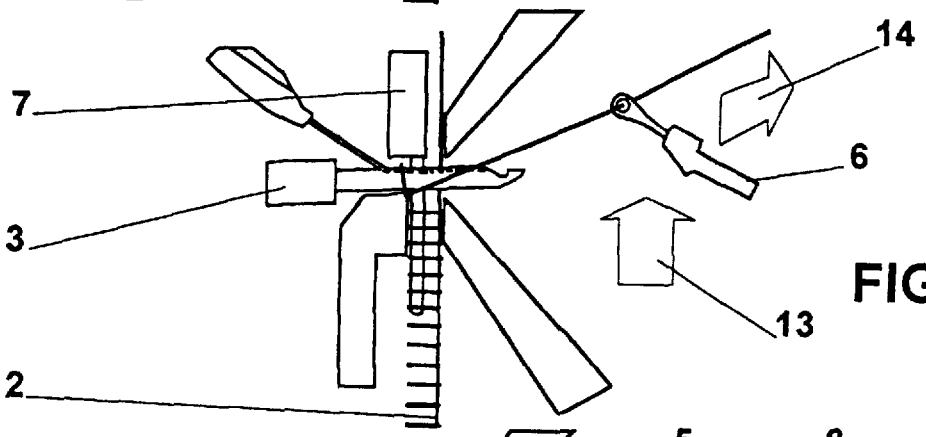
Figure 2C:
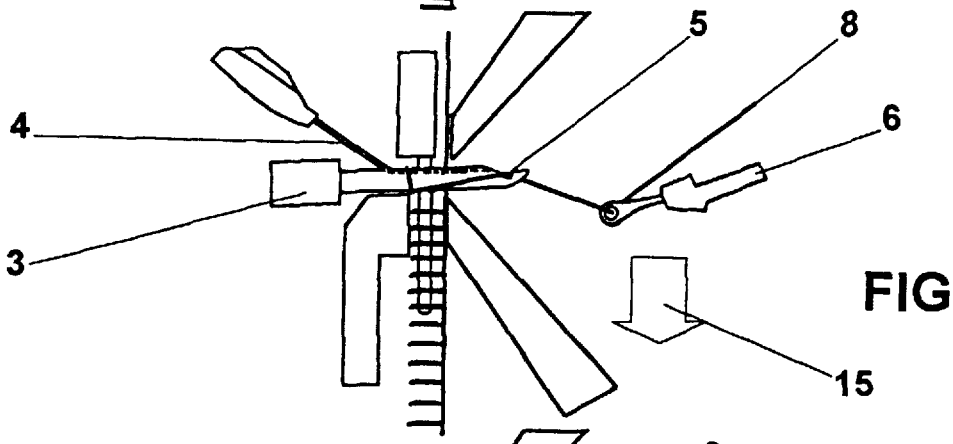

FIGS. 2*a,* 2*b,* 2*c* and 2*d* depict a knitting machine, apt to action the process, showing the four essential steps of the second variation of the manufacturing process by knitting the loops on a sheet according to the invention.

Figure 3A:
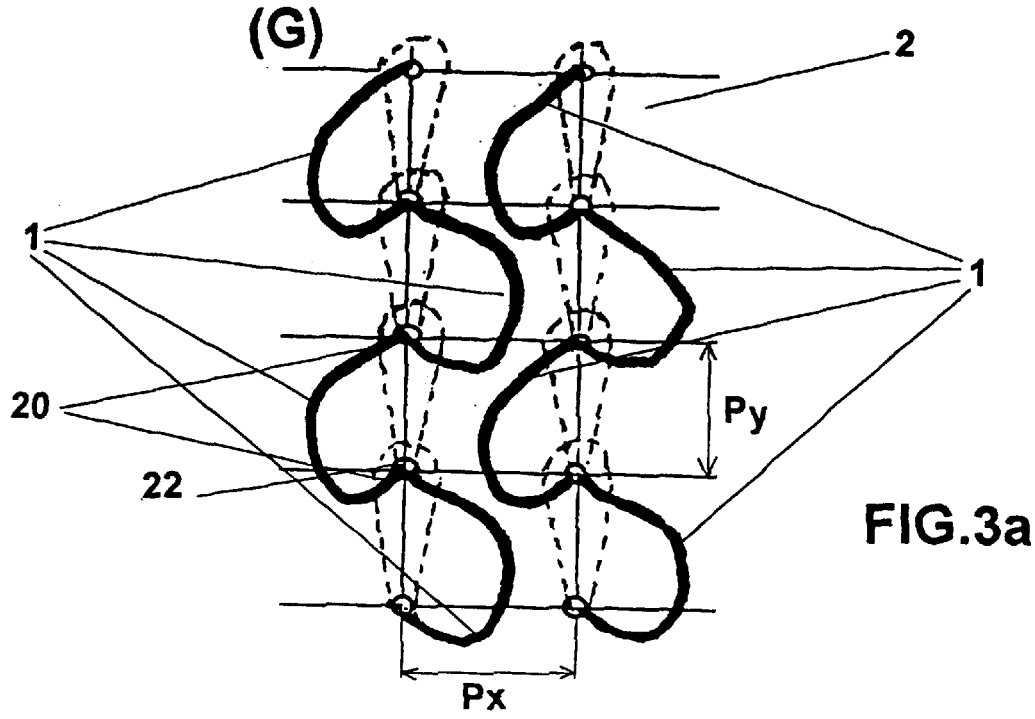

FIG. 3*a* show a view from above (chain-link side) of the material manufactured with the prior process.

Figure 3B:
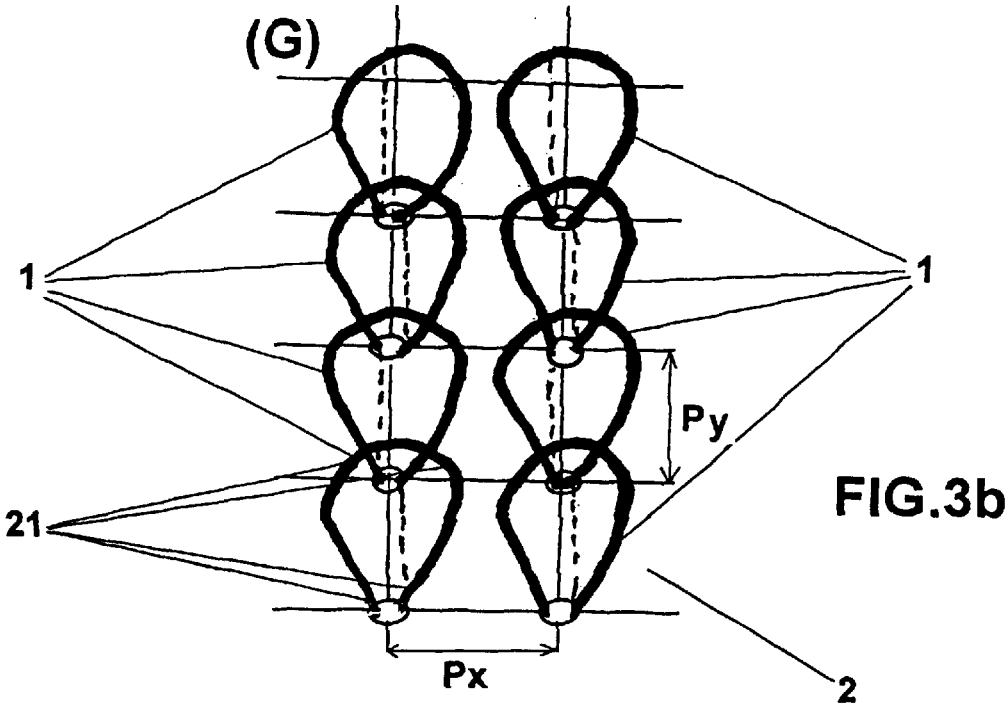

FIG. 3*b* show a view from above (loops side) of the material manufactured with the process described by the invention.

Figure 4:
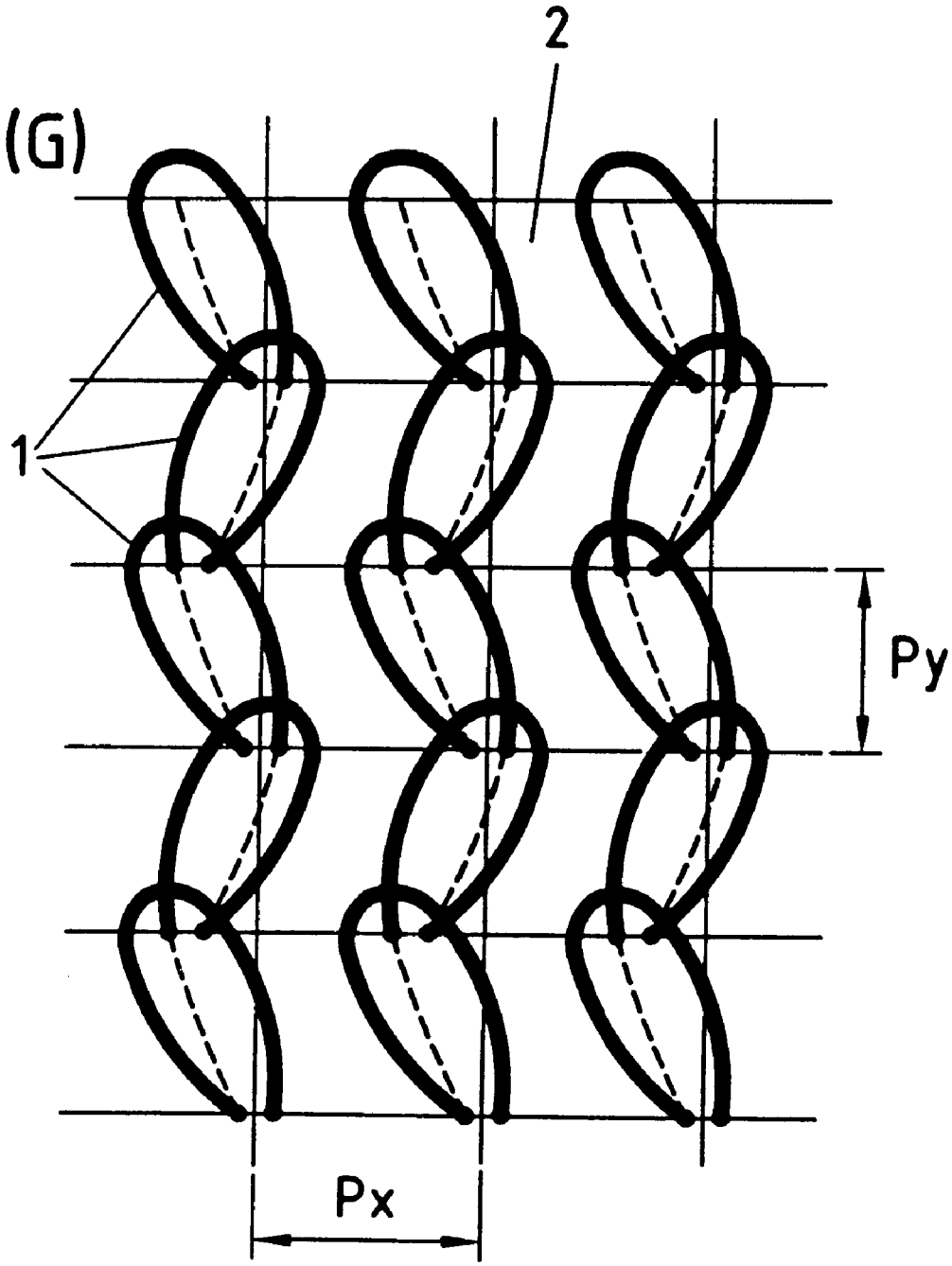

FIG. 4 show a view from above of another material manufactured with the process described by the invention.

DESCRIPTION OF A PREFERRED WAY OF EXECUTING THE INVENTION

References to FIGS. 1*a,* 1*b,* 1*c* and 1*d,* as well as to FIGS. 2*a,* 2*b,* 2*c* and 2*d* will be used to explain the different, characteristics steps of the two variations of the process of formation of loops on a sheet according to the invention.

The different references show the mechanical elements, known for the most part, of a knitting machine of the type manufactured by the company LIBA. The views, very stylized and without indication of the dimensional reference with a view to simplicity, are those of these elements seen from a vertical plane between two columns of loops.

According to a conventional representation, the sheet (2) is presented vertically and the loops (1) which are inserted within, horizontally, whereas in reality needles (3) are most often vertical and to the bottom. The apparatus to displace closing strings (4) are also to the bottom, in reality, and therefore move from bottom to top to close the needle (3) at the level of the hook (5), and from top to bottom to open it.

As is shown in FIGS. 1*a,* 1*b,* 1*c* and 1*d,* the loops (1) are inserted by the needle (3) into the sheet (2) at an angle generally perpendicular to the sheet (2). The needle (3) is also positioned at an angle generally perpendicular to the sheet (2) and cooperates with an apparatus to displace closing strings (4) and a hook (5) for being moved from opened to closed positions.

Needles are held by a transversal and horizontal bar, the section of which is not indicated as such. The same applies to the transversal and horizontal bar supporting the small guides (6), as well as the bar supporting the lancets (7). The string (8) is brought onto the small strainer (6) to form the loops (1) on the lancet (7), which will be fixated onto the sheet (2) by the needle (3).

The knitting machine represented operates continually: the loops (1) are knitted onto the sheet (2) which is fed from the top to the bottom (as shown in the Figures).

Some textile machinery include complementary bars of small strainers (6) so as to better control the movement of strings (8). Those will not be represented here, so as not to confuse about the explanation of the process of knitting loops onto a sheet according to the invention.

Reference (7) as shown in FIGS. 1*a,* 1*b,* 1*c* and 1*d* shows that lancets are located against the sheet (2), on the side facing the small guide (6). This corresponds to one of the two possible configurations according to which the process may take place, and constitutes the first variation.

This position (needle—sheet—lancet—small guide) is classic amongst equipment manufacturers. The loops are therefore, in a known fashion, manufactured in a position thrown under the needle.

According to the first variation of the process described in the invention, the different steps of which are described thereafter, loops (1) are manufactured on a chain-link (on the side opposite to the needles (3)), without throwing, by moving the lancets (7).

FIG. 1*a* shows the first step of the knitting cycle. The needle (3) is in a low position (or back position). The string (8) has been pulled through the sheet (2) by the hook (5) of the needle (felling). The closing needle has freed the needle.

During this step the sheet (2) moves by a stitch and the lancet (7) moves laterally by a distance of one needle (or many) to the right (9)—by the next cycle, the lancet will move to the left (10).

In order to create a loop (1) on this first side (11) of the sheet, the small strainers move laterally to the left (12) to wrap the string (8) on the lancet (7), under the needle (3) (thrown under).

Figure 1B:
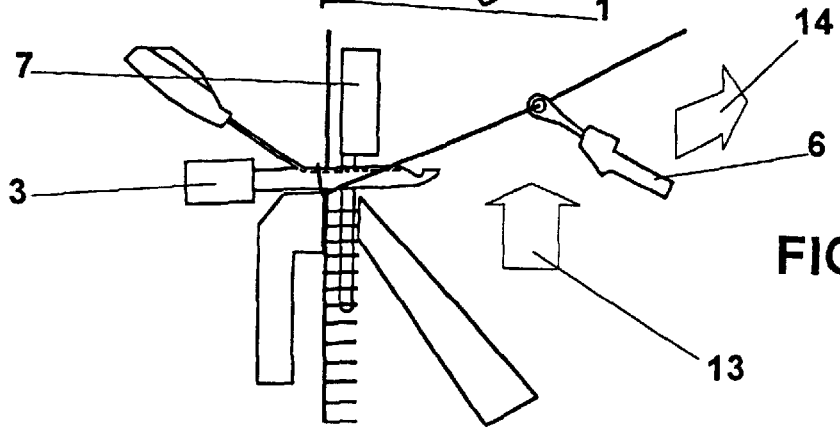
Figure 1C:
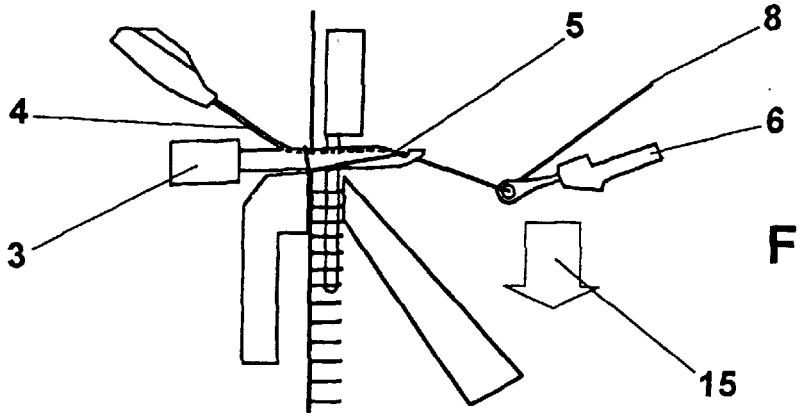

At the next step, as shown in FIG. 1*b* the needle (3) moves towards the small strainer guide (6) and through the sheet (2). The small strainer moves over the needle (3) by a longitudinal move towards the top (13) and a lateral move to the right (14) of a distance equal to a needle. The small guide is then in a position to engage the string (8) in the hook (5) (thrown over) at the next step as shown in FIG. 1*c*.

During this step, the needle (3) begins moving back (or down), whereas the small guide (6) moves towards the bottom (15), placing itself under the needle (3). This traps the string (8) in the needle (3), with the closing string (4) beginning to close it.

Figure 1D:
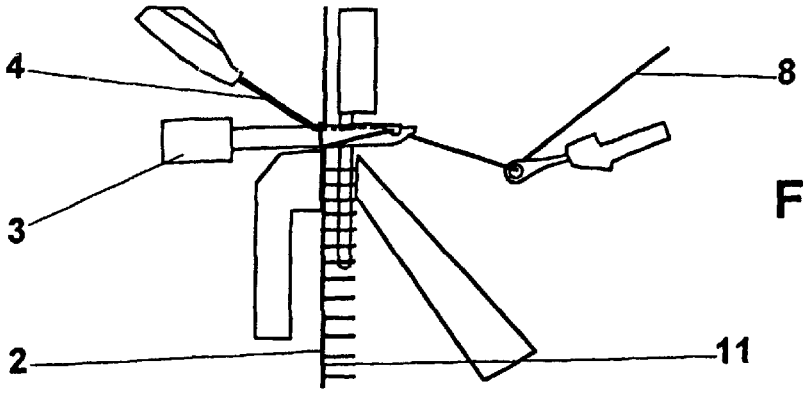

The end of the cycle is represented in FIG. 1*d*. The closing string (4) has closed the needle (3). The needle (3) carries on moving back (or down) and takes the string (8) through the previous stitch on the second side of the sheet (2) (felling). The loop (2) is therefore fixed on the first side (11) and the needle (3) carries on to move towards its bottom position. The closing string (4) opens the needle and the cycle starts again.

A single loop (1), line up on the axis of the column of loops, is formed during each cycle.

Were the first variation of the process to work alongside a classical works configuration, however, the lancet (7) on the second side (16) of the sheet (2), on the side facing the needle, as can be observed in FIGS. 2*a,* 2*b,* 2*c* and 2*d*—is an unusual position for equipment manufacturers.

In this position needle-lancet-sheet-small guide, the loop is formed by the stitch and is only made to appear by the lateral movement (9,10) of the lancet (7).

The four steps of the second variation of the process of loops (1) manufacturing by knitting on a sheet (2), according to the invention, are similar to those described above, relative to the first variation.

Figure 2D:
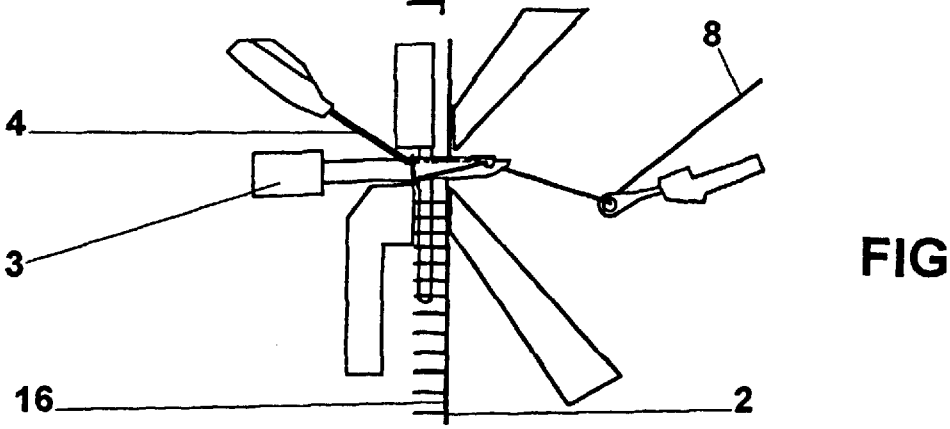

Obviously, during the fourth step of the cycle, as featured in FIG. 2*d*, the loop is not fixed on the first side (11) of the sheet (2) facing the lancets (7): in this case, the string (8) which is pulled by the needle (3) fixes the loop (1), which is itself formed during the previous step, on the second side (16) facing the needle (3).

There are therefore two strings per stitch constituting a double loop (1), the twin curves of which are symmetrically spread with regard to a vertical plane set from the needle line.

Detailed characteristics of the cloth obtained from those two variations of the process will described in conjunction with FIGS. 3*a* and 3*b*.

To complete the presentation of both variations of the process, but to avoid this making it an essential characteristic, the fell guard (17) and the guard to prevent travel of the apparatus towards the top (18) have been kept as such, as shown in FIGS. 1*a,* 1*b,* 1*c* and 1*d,* and FIGS. 2*a,* 2*b,* 2*c* and 2*d*.

In the case of the second variation, one will observe that a guard to prevent travel of the apparatus towards the bottom (19) is implemented, made possible by the position of the gang of lancets (7) on the other side of the sheet (2).

FIG. 3*a* shows the cloth manufactured by a prior art method.

Intersections of the grid (G) represent the impact of a needle (3) through the sheet (2). Loops (1) appear in bold, viewed from above (chain side). The dotted line represents strings (8) under the sheet (2) (stitch side). In the longitudinal direction (from top towards bottom), impact points are separated by a distance (Py), which is equal to the pitch of the needles (3).

In the transversal direction, stitches are separated by a distance (Px). This distance is at least equal to the pitch of one needle.

The process enables the production of loops (1), the feet of which are made of strings (8) rising perpendicularly from the perforations of the support (2).

The process according to the invention allows the production of a loop cloth as shown in FIG. 3*b*. Loops (1) are featured in bold, viewed from below (stitch side). The dotted line represents strings (8) over the sheet (2) (chain side). Loops (1) that are formed are double loops, the feet of which, to the bottom, rise from the stitches perpendicularly to the sheet (2) and, to the top, are fixed to the next loop in an orthogonal fashion compared to the sheet (2).

Approximately eighty percent of the string is used to produce loops and only twenty percent of the string is used to secure those loops.

Following the required dimension of the loops and the supporting sections, this percentage can vary between ninety percent and sixty percent.

Loops (1) are not perfectly straight. They feature a different orientation, however without any common measure when compared to products realized by knitting on a sheet, as by the prior method.

A preferred manufacturing application of the cloth as produced by the process according to the invention is a cloth constituting of a film (2) or a non-woven cloth made of polyester, polyethylene or polypropylene, with loops (1) made of polyamide or polyester string (8).

Depending on the intended use of a cloth so manufactured, density of the sheet (1) will vary between fifteen to twenty g/m$^2$.

Specialists will easily envisage numerous applications for the loop cloth manufactured by the process according to the invention. Particularly, a cloth manufactured in specific circumstances may not feature loops on the entire surface. Only pre-determined parts will feature loops, which will have been adapted to the final product to be manufactured.

When co-operating with the complementary parts, including hooks for example, the benefit of loops seamlessly integrated to the product will be an improved resistance to tearing, as opposed to loops fixed on a support adhered to or sewn to the product.

The process according to the invention is therefore particularly suited for the manufacturing of products, the auto-gripping straps' specifications of which are particularly stringent, as with diapers.

Of course, the invention is limited neither to the implementation process nor the application method that have been described. One could very well conceive diverse variations without however exiting the domain of the invention.

A cloth different from that which is represented in FIG. 3*b* is featured in FIG. 4. The double loops are manufactured following a zig-zag pattern, this as a result of crisscrossing the needle impacts on the support. Double loops that hold better are therefore obtained.

What is claimed is:

1. The process of creating loops on a cloth by knitting, including the following steps:

to realize longitudinal columns of intermediary loops on one side of the support, and columns of stitches on the other side of the support, by driving a string brought by small strainers on the one side of said support, with needles, onto lancets which are on the same side of support;

to retain the intermediary loops on the support by driving the string on the other side of the support, after the creation of at least the first of the intermediary loops on one of the lancets;

to move transversally, in one direction and by a predetermined distance the lancet holding the first intermediary loop, with a view to create a second intermediary loop; and after the creation of the second intermediary loop on the lancet, to again move the lancet holding both the first and second intermediary loops transversally, by the same distance but in the opposite direction, so as to create a third intermediary loop on this lancet, the cycle of transversal movement of the lancet in one direction then the other being repeated every two intermediary loops, wherein it includes a further step consisting of pulling the intermediary stitches away from the support to create the loops, the intermediary loops being therefore pressed against the support to create the retaining sections.

2. A looped cloth for use with complementary hooked material to form a hook-and-loop fastener system, comprising a cloth support having two opposed sides and at least one string, said string including loop sections and restraining sections, said restraining sections being on one side of said cloth support, said loop sections protruding from the other side of the cloth support, each of the loop sections extending along a loop length between a starting foot and an end foot, each of the restraining sections extending along a restraining length between two starting feet of two loop sections, wherein said loop length is longer than said restraining length as measured along said string, and at least one restraining section extends between two starting feet on a straight line along said string.

3. A loop cloth as defined in claim 2, wherein each restraining section extends between a starting foot of a loop and an end foot of the loop.

4. A loop cloth as defined in claim 2, wherein each of the loop sections comprises a double loop.

5. A loop cloth as defined in claim 3, wherein each of the loop sections comprises a double loop.

6. A loop cloth as defined in claim 2, wherein contacting means are provided to maintain said restraining sections in contact against said cloth support.

7. A loop cloth as defined in claim 3, and including contacting means to maintain said restraining sections in contact against said cloth support.

8. A loop cloth as defined in claim 4, and including contacting means to maintain said restraining sections in contact against said cloth support.

9. A loop cloth as defined in claim 5, and including contacting means to maintain said restraining sections in contact against said cloth support.

10. A loop cloth as defined in claim 6, 7, 8 or 9, wherein said contacting means comprises glue.

11. The process of creating loops on a cloth by knitting following one of claims 2 to 9, including the following steps:

realizing longitudinal columns of loops on one side of the support, and columns of retaining sections on the other side of the support, by driving a string brought by small strainers on the other side of said support, with needles, onto lancets which are on the one side of said support;

retaining the loops on the support by driving the string on the other side of the support, after the creation of at least the first of the loops on one of the lancets;

moving transversally, in one direction and by a predetermined distance the lancet holding the first loop, with a view to create a second loop; and after the creation of the second loop on the lancet, to again move the lancet holding both the first and second loops transversally, by the same distance but in the opposite direction, so as to create a third loop on this lancet, the cycle of transversal movement of the lancet in one direction then the other being repeated every two loops.

12. The process following either claim 1 or claim 11, wherein compounds to glue the retaining sections to the support are applied on the support on the side of the retaining sections, notably a layer of glue.

13. The process of creating loops on a cloth by knitting following either claim 1 or 11 wherein it includes:

a first step during which, successively, said needles having moved from the lower position to the back position, the felling having just completed, the support advances by one stitch, said lancets move transversally and said small strainers accomplish a first lateral movement in the said opposite direction behind said needles, a second step during which, successively, said needles move towards said small strainers, punch through the support, move through the comb of the lancets, then said small strainers accomplish a first longitudinal movement towards said top, followed by a second lateral movement of a step towards the said initial direction, a third step during which, successively, said needles begin their return to the back position, then said small strainers move under said needles by a second longitudinal movement towards said bottom, said second longitudinal movement having for effect to snare each of said strings in said hook, then said closing strings begin to close said needles, a fourth step during which, successively, said closing strings having closed said needles, said needles carry on their return to the back position until the moment when, said strings moving through the support and forming said loops on said first side, the fell is completed, then needles carry on towards the lower position and finally said closing strings open said needles said first, second, third and fourth steps taking place in a cyclical fashion.

14. A diaper, comprising a looped cloth for use with complementary hooked material to form a hook-and-loop fastener system, including a cloth support having two opposed sides and at least one string, said string including loop sections and restraining sections, said restraining sections being on one side of said cloth support, said loop sections protruding from the other side of the cloth support, each of the loop sections extending along a loop length between a starting foot and an end foot, each of the restraining sections extending along a restraining length between two starting feet of two loop sections, wherein said loop length is longer than said restraining length as measured along said string, and at least one restraining section extends between two starting feet on a straight line along said string.

15. A diaper as defined in claim 14, wherein each restraining section extends between a starting foot of a loop and an end foot of the loop.

16. A diaper as defined in claim 14, wherein each of the loop sections comprises a double loop.

17. A diaper as defined in claim 15, wherein each of the loop sections comprises a double loop.

18. A diaper as defined in claim 14, and including contacting means to maintain said restraining sections in contact against said cloth support.

19. A diaper as defined in claim 15, and including contacting means to maintain said restraining sections in contact against said cloth support.

20. A diaper as defined in claim 16, and including contacting means to maintain said restraining sections in contact against said cloth support.

21. A diaper as defined in claim 17, and including contacting means to maintain said restraining sections in contact against said cloth support.

22. A diaper as defined in claim 18, 19, 20 or 21, wherein said contacting means comprises glue.

* * * * *